US006672831B2

(12) United States Patent
Brandl et al.

(10) Patent No.: US 6,672,831 B2
(45) Date of Patent: Jan. 6, 2004

(54) DEVICE FOR SETTING THE GAP DIMENSION FOR A TURBOMACHINE

(75) Inventors: Herbert Brandl, Waldshut-Tiengen (DE); Armin Busekros, Zurich (CH); Peter Marx, Baden (CH); Ulrich Rathmann, Baden (CH); Ulrich Wellenkamp, Windisch (CH)

(73) Assignee: Alstom Technology Ltd, Baden (CH)

( * ) Notice: Subject to any disclaimer, the term of this patent is extended or adjusted under 35 U.S.C. 154(b) by 84 days.

(21) Appl. No.: 09/995,583

(22) Filed: Nov. 29, 2001

(65) Prior Publication Data

US 2002/0071763 A1 Jun. 13, 2002

(30) Foreign Application Priority Data

Dec. 7, 2000 (DE) ..... 100 60 740

(51) Int. Cl.[7] ..... F01D 11/22
(52) U.S. Cl. ..... 415/173.2
(58) Field of Search ..... 415/126, 127, 415/128, 173.1, 173.2, 173.3

(56) References Cited

U.S. PATENT DOCUMENTS 3,520,635 A * 7/1970 Killmann et al. .... 415/173.2 X
4,330,234 A 5/1982 Colley
4,332,523 A * 6/1982 Smith ..... 415/126
4,863,345 A 9/1989 Thompson et al.
5,228,828 A 7/1993 Damlis et al.

FOREIGN PATENT DOCUMENTS

DE 1178253 9/1964

* cited by examiner

*Primary Examiner*—Edward K. Look
*Assistant Examiner*—Richard A. Edgar
(74) *Attorney, Agent, or Firm*—Burns, Doane, Swecker & Mathis, L.L.P.

(57) ABSTRACT

A device for setting the gap dimension for a turbomachine, in particular a gas turbine, with heat accumulation segments which are arranged on the guide-vane carrier of the rotor arrangement. At least one drive device projects radially through the turbine casing and the guide-vane carrier and is operatively connected kinematically to at least one heat accumulation segment and which, when actuated, causes a radial spacing of the heat accumulation segment. The heat accumulation segment has, in the flow direction of the turbomachine, a conical contour facing the rotor arrangement and is arranged so as to be displaceable parallel to the flow direction, and in that the drive device is connected to the heat accumulation segment directly or via an eccentric unit, in such a way that, when the drive device is actuated, the heat accumulation segment is displaced, with the result that a radial spacing between the heat accumulation segment and the moving-blade tips can be set.

16 Claims, 6 Drawing Sheets

DEVICE FOR SETTING THE GAP DIMENSION FOR A TURBOMACHINE

FIELD OF THE INVENTION

The invention relates to a device for setting the gap dimension for a turbomachine, in particular for a gas turbine, with a multiplicity of moving blades arranged in at least one moving-blade row of a rotor arrangement, with a guide-vane carrier surrounding the rotor arrangement and also a turbine casing surrounding the guide-vane carrier, with a multiplicity of heat accumulation segments which are arranged on the guide-vane carrier of the rotor arrangement and at least opposite the moving-blade tips and, together with the moving-blade tips, enclose a gap, and also with at least one drive means which projects radially through the turbine casing and the guide-vane carrier and is operatively connected kinematically to at least one heat accumulation segment and which, when actuated, brings about a radial spacing of the heat accumulation segment.

BACKGROUND OF THE INVENTION

Turbomachines of the abovementioned type serve primarily either for the controlled compression of gases, as is the case in compressor stages, known as compressors in turbo plants, or for the controlled expansion of highly compressed and fast-flowing media for the drive of gas turbines which are used in a way known per se for energy recuperation. In order to make energy recuperation by means of gas turbine plants as efficient as possible, a declared aim of efforts toward optimization is to increase the efficiency of turbomachines of this type. Attempts are made, by a series of technical measures, to counteract loss mechanisms which occur both when compressing the working media to be compressed and when driving of turbines.

In this connection, it is expedient, in particular, to keep the radial gaps forming in thermal turbomachines between the rotating and the stationary plant components as small as possible, in order to keep as low as possible the loss streams which pass through these gaps and constitute small, but still existing part mass streams of the working medium passing through the turbomachine, without at the same time participating in the desired energy conversion. Loss streams thus constitute loss mechanisms which may considerably reduce the efficiency of turbomachines. Moreover, the hot loss streams lead to heating or overheating of the blade tips. If attempts are made to keep the gaps small, with the result that the loss streams and therefore the heating of the blade tips also remain low, cooling measures are possible more easily or at a lower outlay.

The particular problem with regard to the reduction of loss streams is, on the one hand, the need for a discrete spacing between the stationary and rotating components of a turbomachine, in order to ensure the free running of the rotor arrangement; on the other hand, it is expedient, for the reasons mentioned, to keep this very interspace as small as possible, this being made more difficult by the fact that the plant components of the turbomachine expand under thermal and mechanical load, with the result that the relative positions of the individual components change during the operation of a turbomachine on account of different thermal expansion behaviors. This makes it difficult, moreover, to have as minimal a gap dimensioning as possible for the entire operating range of a turbomachine which, depending on the type of turbomachine, is exposed to a wide temperature spectrum. Thus, because of the centrifugal forces acting on the rotating components and their natural heating, they are subject to more rapid expansion, which would lead, in principle, to a gap reduction, than the complex thermally insulated components of the stator which experience slower heating and, in a thermally stationary operating state, contribute by expansion to an enlargement of the gap dimension. It is expedient, however, to keep this gap dimension as small as possible during operation.

Both active and passive measures are known for monitoring or influencing the gap dimension, passive precautions superficially seeming to be more advantageous, especially since active control precautions implemented by mechanical setting systems for gap control have high complexity and are suitable only to a limited extent for robust machines subjected to high thermal load, such as, for example, gas turbine plants.

One possibility for implementing gap control passively is the specific optimization of material combinations having specifically selected coefficients of thermal expansion, which brings about thermal expansion in all the plant components determining the gap, with the result that, on the one hand, the gap assumes a minimum size and, on the other hand, this minimum gap width is maintained over the entire operating range, that is to say temperature range, of the turbomachines.

Due to the highly complex configuration of known turbomachines, the possibilities for any desired choice of material combinations for stator and rotor components in order to improve the thermal behavior are very limited. Although the choice of material can be made, while taking into account the problem of the gap width, it has nevertheless not been possible hitherto to solve satisfactorily the problem of reducing the gap dimension merely by the choice of the material combination alone.

Another possibility for keeping the gap dimension small is to take into account abrasive surface actions on stator and rotor components. In this case, the surfaces located opposite one another and almost in contact are provided at least partially with abrasive surface coatings which, when the turbomachine is in operation, are stripped away in a controlled manner by being intentionally ground off or down and which thus result in an optimized gap.

However, after only one operating cycle of the turbomachine, the gap forming as a result of abrasive action has an optimized maximum gap width, but one which cannot be reduced again.

Finally, structural measures for a uniform expansion of the rotor and stator components of a turbomachine are also possible, but, overall, entail a considerable extra outlay in structural terms and, moreover, are not suitable for robust use with long-time stability in gas turbines.

Thus, a device for setting the gap between turbine blades and a heat accumulation segment may be gathered from U.S. Pat. No. 5,228,828. The following statements refer to the exemplary embodiment illustrated in FIG. 1 of the US publication. A heat accumulation segment 18, 82 is arranged opposite the individual turbine blade tips 14, 16. The two components enclose a gap. Through the turbine casing wall 36 projects a rotary shaft 12 which is connected to a control cam 44 within the turbine casing. The control cam 44 spaces the flanks 48 and 54 from one another, especially since the components 46 and 52 are clamped together by means of the spring 76. The components 46 and 52 then engage, on the other hand, into corresponding extensions 84 and 86 of the heat accumulation segment 18, in such a way that, in the event of a relative movement of the two components 46 and 52, the heat accumulation segment 18 moves radially away from the turbine blade tips 14 and 16 or toward these. A relative movement of the two components 46 and 52 may be carried out by means of a rotation of the rotary shaft 12 and of the control cam 44 connected to the latter.

The illustration of this known device clearly shows a complicated construction involving a high outlay, with the result that the operation of the gas turbine becomes more susceptible to repair and maintenance.

SUMMARY OF THE INVENTION

The object on which the invention is based is to develop a device for setting the gap dimension for a turbomachine, in particular a gas turbine with a multiplicity of moving blades arranged in at least one moving-blade row of a rotor arrangement, with a guide-vane carrier surrounding the rotor arrangement and also a turbine casing surrounding the guide-vane carrier, with a multiplicity of heat accumulation segments which are arranged on the guide-vane carrier of the rotor arrangement and at least opposite the moving-blade tips and which, together with the moving-blade tips, enclose a gap, and with at least one drive means which projects radially through the turbine casing and the guide-vane carrier and is operatively connected kinematically to at least one heat accumulation segment and which, when actuated, causes a radial spacing of the heat accumulation segment, in such a way that, irrespective of the operating state of the turbomachine, the gap has as small a gap width as possible, which can be actively regulated, but at the same time does not require a complicated construction. The mechanical structural measures to be taken in this case are to be implemented simply and cost-effectively and are to satisfy the requirements of robust use with long-term stability, for example in a gas turbine which is in stationary operation.

The solution for achieving the object on which the invention is based is specified in claim 1. Features advantageously developing the idea of the invention are the subject matter of the subclaims and may be gathered from the description and the figures in order to explain exemplary embodiments.

The device according to the invention, as featured in the preamble of claim 1, is designed in that the heat accumulation segment has, in the flow direction of the turbomachine, a conical contour facing the rotor arrangement and is arranged so as to be displaceable parallel to the flow direction, and in that the drive means is connected to the heat accumulation segment directly or via an eccentric unit, in such a way that, when the drive means is actuated, the heat accumulation segment is displaced, with the result that a radial spacing between the heat accumulation segment and the moving-blade tips can be set.

The conical contour of the heat accumulation segment is formed preferably either by a cone envelope or by any by any desired generating curves widening in the flow direction.

The principle on which is based the adjusting mechanism according to the invention for a specific setting of the gap dimension is based on the fact that the gap space enclosed between the moving-blade tips and the heat accumulation segment designed conically in the flow direction is oriented obliquely to the flow direction or to the axial extent of the turbine casing, especially since the moving-blade end edges located at the moving-blade tips are oriented at an inclination to the axis of the rotor arrangement. When, then, a heat accumulation segment, of which the surface facing the rotor arrangement runs approximately parallel to the moving-blade end edges, is arranged on the guide-vane carrier so as to be spaced in this way, it is sufficient merely to obtain the axial displacement of the heat accumulation segment in order to change the actual radial clearance between the heat accumulation segment and the moving-blade end edge.

As simple a construction as possible of the device according to the invention for setting the gap dimension is implemented, in particular, by a simple and direct kinematic coupling of a drive means to the heat accumulation segment. Alternative solutions for a kinematic coupling of this type are described with reference to the exemplary embodiments described in more detail below. The drive means ensures, in particular, the axial displaceability of the heat accumulation segment, with the result that the radial clearance between the heat accumulation segment and the moving-blade tip can be set specifically. Preferably, the drive means projecting from the turbine casing is connected to a corresponding drive system which, in turn, is provided with an overload or slipping clutch which ensures that, in the event of contact between the heat accumulation segment and a moving-blade tip, no further axial advance and therefore radial approach between the heat accumulation segment and a moving-blade tip can take place. In particular, the overload unit, designed as an overload clutch, ensures that, in the event of force-induced contact between the heat accumulation segment and at least one moving-blade tip, that position of the heat accumulation segment is maintained in which the heat accumulation segment is just not in contact with the moving-blade tip and a minimum intermediate gap is therefore enclosed between the moving-blade tip and the heat accumulation segment.

In the direction of rotation of the guide-vane tips rotating within the guide-vane carrier, a multiplicity of directly adjacent heat accumulation segments for each moving-blade row are arranged opposite the moving-blade tips. Each individual heat accumulation segment is provided with a device according to the invention for setting the gap dimension, so that a multiplicity of drive means projecting through the turbine casing are provided. In principle, it is possible, by the individual actuation of every single drive means, to adjust every single heat accumulation segment individually in space, but it is also conceivable to couple the drive means for each single heat accumulation segment to one another mechanically and activate them correspondingly via a common adjusting mechanism.

BRIEF DESCRIPTION OF THE DRAWINGS

The invention is described below by way of example, without the general idea of the invention being restricted, by means of exemplary embodiments, with reference to the drawing in which.

DETAILED DESCRIPTION OF THE INVENTION

Figure 1A:
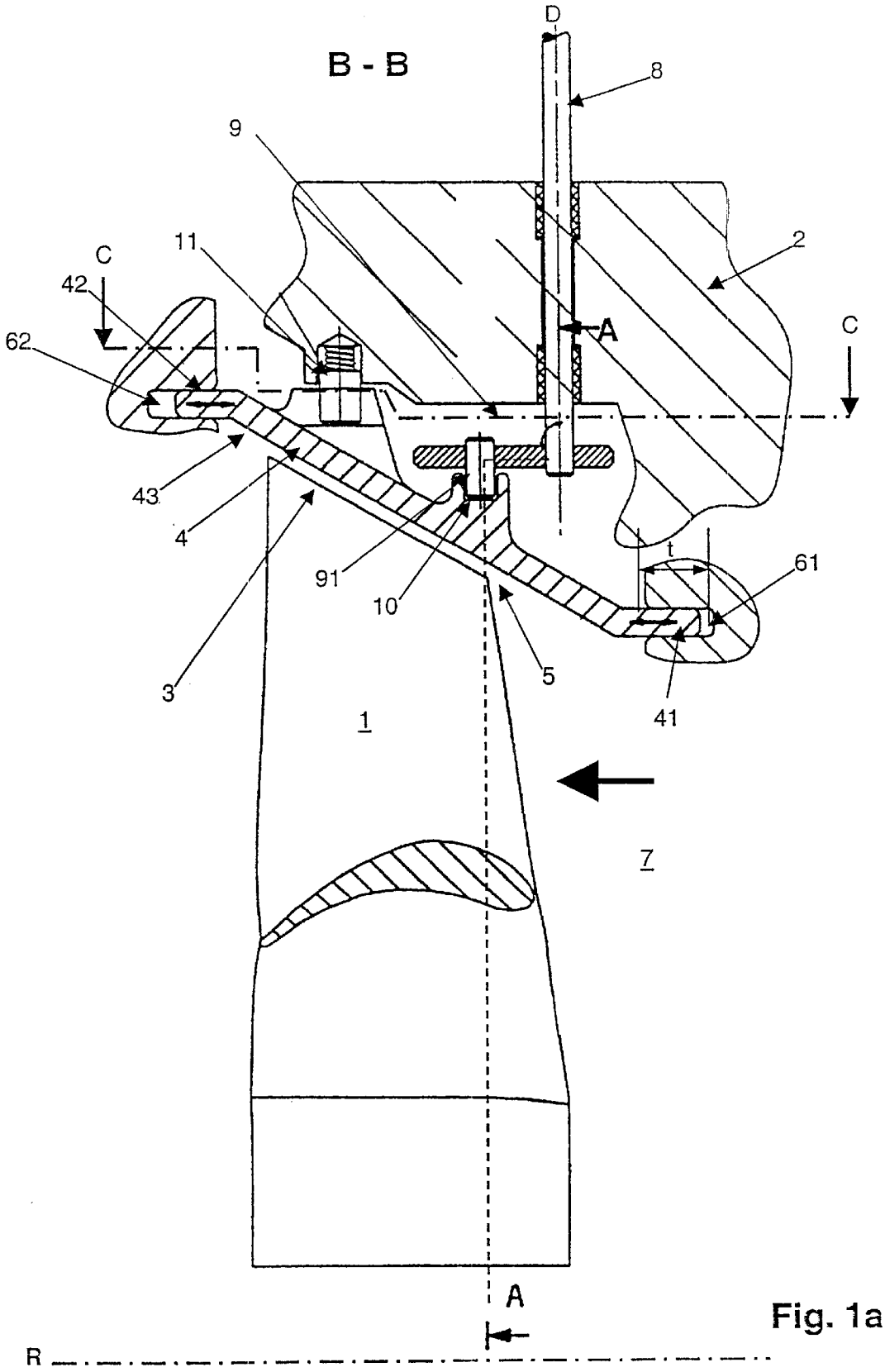
FIG. 1*a* shows a side view of a cross-sectional illustration of a device for setting the gap dimension, with an eccentric mechanism.

FIG. 1*a* shows a sectional view longitudinally to the run of a moving blade 1 which rotates about an axis of rotation R and which is provided inside a turbomachine surrounded by a guide-vane carrier 2. The moving blade 1 illustrated in FIG. 1*a* represents one moving blade of a multiplicity of moving blades which are arranged within a moving-blade row of a rotor arrangement, not illustrated in any more detail, having the axis of rotation R. Between the guide-vane carrier 2 and the tip of the moving blade 1, said tip being designed as a moving-blade end edge or "moving-blade crown" 3, is provided a heat accumulation segment 4 which, together with the moving-blade end edge 3, encloses an intermediate gap 5. The heat accumulation segment 4, which is likewise illustrated as representing a multiplicity of heat accumulation segments arranged opposite the moving-blade tips of a moving-blade row along its entire inner region of rotation, is designed in the form of a cylinder segment, as may be gathered particularly from a comparison of the cross-sectional illustration according to FIG. 1*a* and the top view according to FIG. 1*c*, which will also be discussed in more detail, and has, in particular, two opposite edges 41, 42 which issue in two corresponding countercontoured groove runs 61, 62. Preferably, the groove runs 61, 62 are located within the guide-vane carrier 2 or in components of the rotary machine which are connected firmly to the guide-vane carrier 2.

The heat accumulation segment 4 has a surface 43 which faces the flow duct 7 conically and which, in axial section, is oriented preferably parallel to the moving-blade end edge 3 inclined obliquely to the axis of rotation R. Moreover, the groove runs 61 and 62 each have a groove depth t which is dimensioned such that the heat accumulation segment 4 is displaceable (see the double-arrow illustration) axially or parallel to the axis of rotation. As may be gathered from the sectional illustration according to FIG. 1*a*, by virtue of the axial displacement of the heat accumulation segment 4 a radial individual spacing between the heat accumulation segment 4 and the moving blade 1 can be carried out owing to the inclined position, relative to the axis of rotation R, of the top side 43 of the heat accumulation segment 4 and of the moving-blade end edge 3. Thus, by the axial displacement of the heat accumulation segment 4, the gap width of the gap 5 can be set, preferably minimized.

A drive system, which is composed of a drive means 8 and of an eccentric unit 9, serves for the axial displacement of the heat accumulation segment 4. The drive means 8 is designed as a rod-like rotary spindle and projects through the guide-vane carrier 2 into an inner space within the turbomachine, said inner space being delimited by the heat accumulation segment 4 and the guide-vane carrier 2. Attached firmly to the end of the drive means 8 designed as a rod-like rotary spindle is the eccentric unit 9 which projects with a guide pin 91 into a guide slot 10 which is part of the heat accumulation segment 4. The guide slot 10 is of linear design and is arranged perpendicularly to the flow direction (see the bold arrow) through the turbomachine, as may be gathered particularly from the top view according to FIG. 1*c*, which will be discussed in more detail.

When, then, the drive means 8 designed as a rod-like rotary spindle is rotated about its axis of rotation D, the rotational movement is converted via the eccentric unit 9 and the guide pin 91, owing to the guide slot 10, into a linear movement by means of which the heat accumulation segment 4 is displaced axially within the groove runs 61, 62. Depending on the direction of rotation of the drive means 8, the heat accumulation segment 4 can be radially spaced from the moving-blade end edge 3 or brought nearer to the latter.

So that the heat accumulation segment 4 remains fixed within the turbomachine in the circumferential direction, a spin-tensioned bolt 11 is provided, which prevents the heat accumulation segment 4 from moving in the circumferential direction.

Figure 1B:
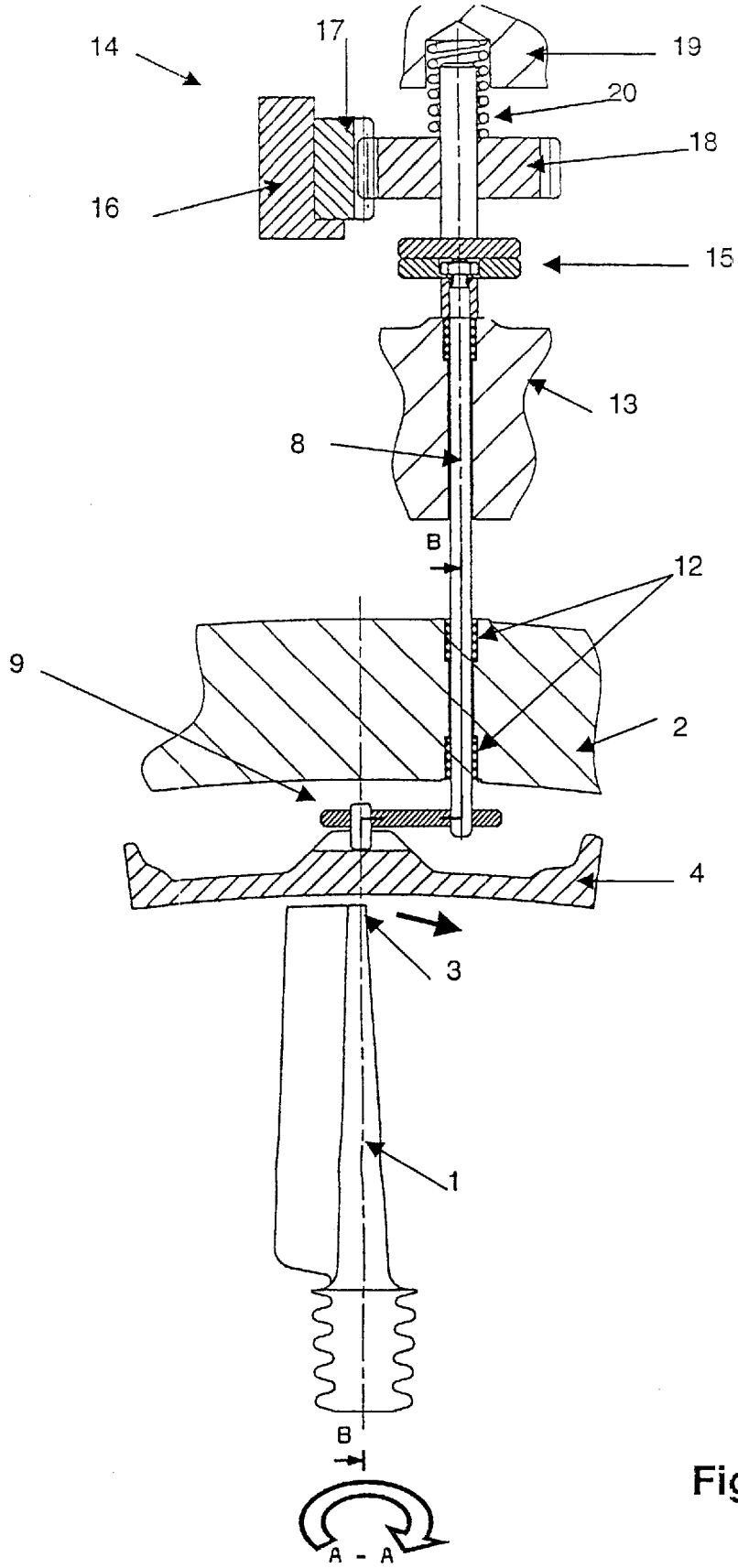
FIG. 1*b* shows a front view of a vertical sectional illustration of the device shown in FIG. 1*a*.

FIG. 1*b* shows a further sectional illustration through the exemplary embodiment already illustrated in FIG. 1*a*. The sectional illustration in FIG. 1*b* corresponds to the section along the sectional line A—A which is plotted in FIG. 1*a*.

The moving blade 1 according to FIG. 1*b* is illustrated in the flow direction (directed into the drawing plane). Provided radially opposite the moving-blade end edge 3 is the heat accumulation segment 4 which is connected via the eccentric unit 9 to the drive means 8 designed as a rod-like rotary spindle. The drive means 8 in this case projects through the guide-vane carrier 2, in which the drive means 8 is guided in two separate sleeve-type ball-bearings 12. Furthermore, the drive means 8 projects through the turbine casing 13 which surrounds the entire turbomachine, including the guide-vane carrier 2.

Outside the turbine casing 13, a drive unit 14 and an overload unit 15 are kinematically coupled to the drive means 8. The drive unit 14 consists of an adjusting ring 16, of a rack segment 17 and of a gearwheel 18 which projects into the rack segment 17 and which is firmly connected to the drive means 8. A fixed counterstop 19, against which is prestressed a spring 20 which, in turn, presses in a force-induced manner against the gearwheel 18, ensures, in conjunction with the overload unit 15 designed as an overload clutch, that the drive means 8 is driven with a limited torque.

When the drive unit 14 is appropriately actuated, the heat accumulation segment 4 is displaced axially due to the rotation of the drive means 8, with the result that the gap 5 can be reduced specifically. If force-induced contact occurs between the heat accumulation segment 4 and the moving-blade end edge 3, the rubbing causes a force to be transmitted to the heat accumulation segment 4, the eccentric unit 9 and the overload unit 15. In this case, the overload clutch 15 slips, thus ensuring that no serious damage can occur as a result of the rubbing of the moving-blade tip against the heat accumulation segment.

Alternatively to the drive unit 14 and overload unit 15 illustrated in FIG. 1*b*, a multiplicity of alternative solution possibilities, using gearwheels, racks and adjusting belts, for implementing the abovementioned securing mechanism may be envisaged.

It is possible, in principle, for every single drive means 8 to be actuated individually. However, the individual drive means 8 may also be coupled mechanically to one another in such a way that an overriding regulating mechanism jointly positions the multiplicity of individual heat accumulation segments.

Figure 1C:
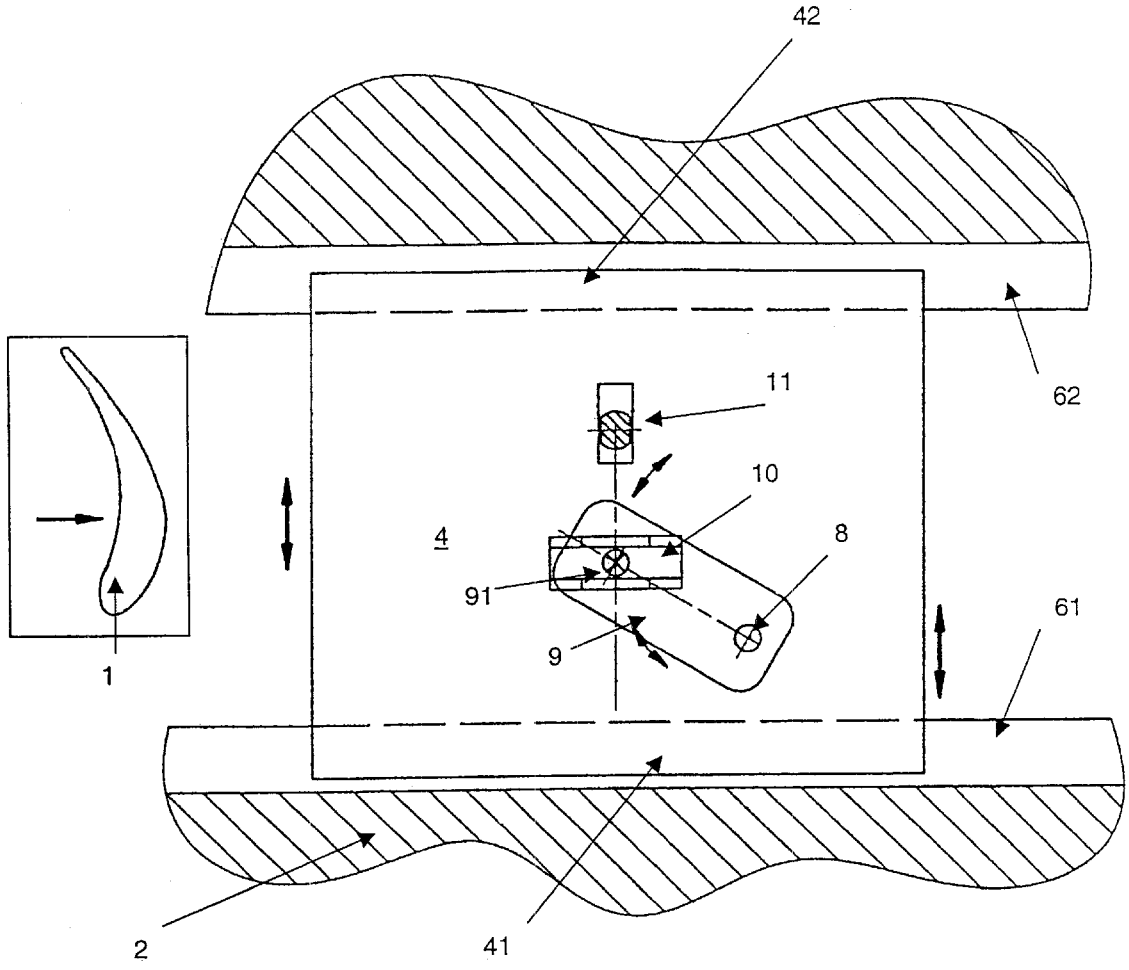
FIG. 1*c* shows a composite illustration of a top view along a sectional line B—B in FIG. 1*b*.

In FIG. 1*a*, the sectional line C—C is shown along which the sectional diagram according to FIG. 1*c* is obtained. This is, in particular, a top view of the heat accumulation segment 4 which projects on both sides, along its two edges 41, 42, into the groove runs 61, 62 of a guide-vane carrier 2. The double-arrow illustration above and below the heat accumulation segment indicates the axial displaceability within the groove run 61. Moreover, for greater clarity, a moving blade 1, which stands on a platform in the root region, is illustrated with a corresponding direction of movement. The rotary spindle of the drive means 8 is illustrated in a top view and is connected via the eccentric unit 9 to the guide pin 91 which projects into the guide groove 10 of the heat accumulation segment 4. The spring-loaded bolt 11 secures the heat accumulation segment 4 against slipping out of place in the circumferential direction.

Figure 2A:
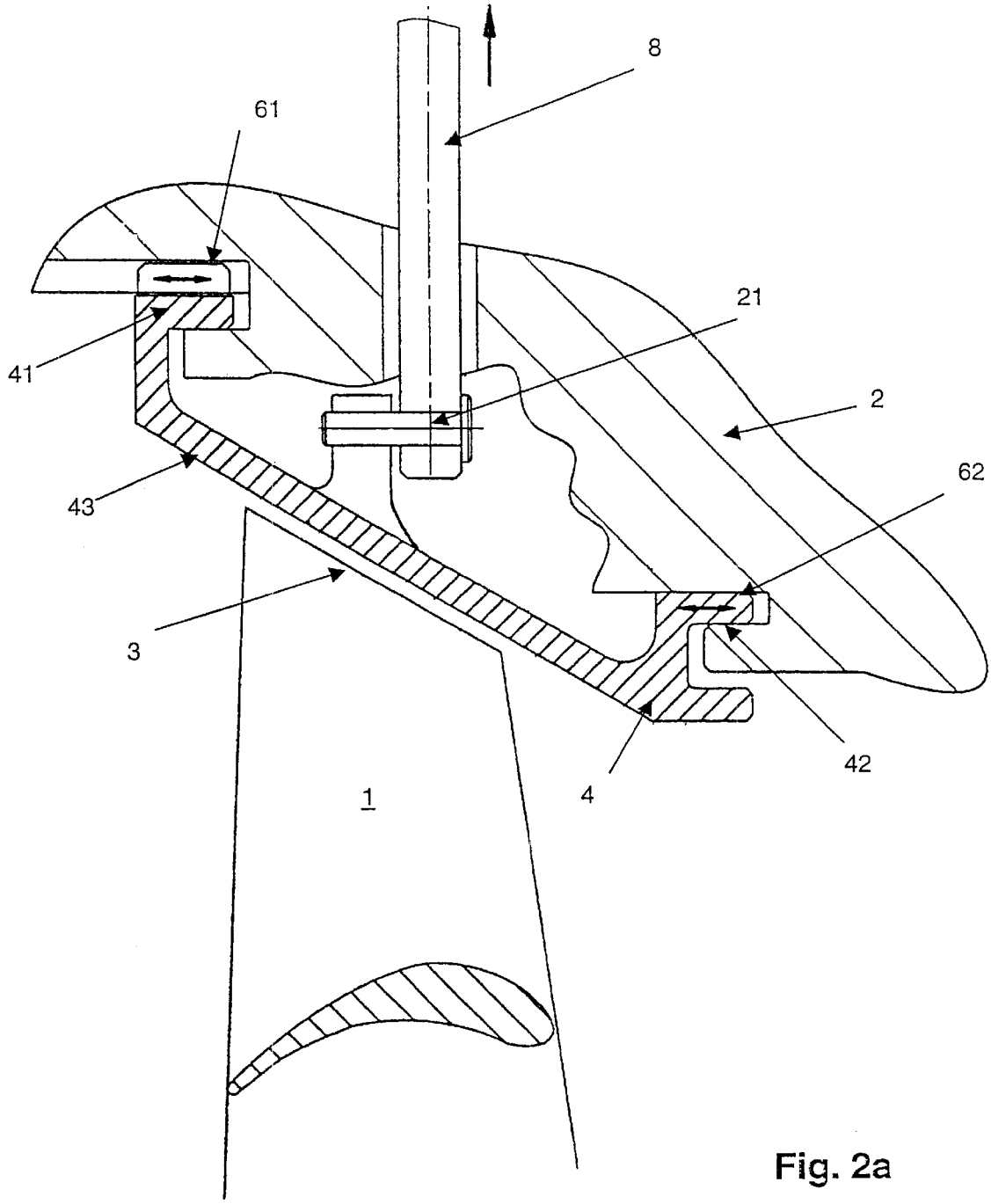
FIG. 2*a* shows an exemplary embodiment of a device for setting the gap dimension, with direct kinematic coupling between the drive means and the heat accumulation segment.
Figure 2B:
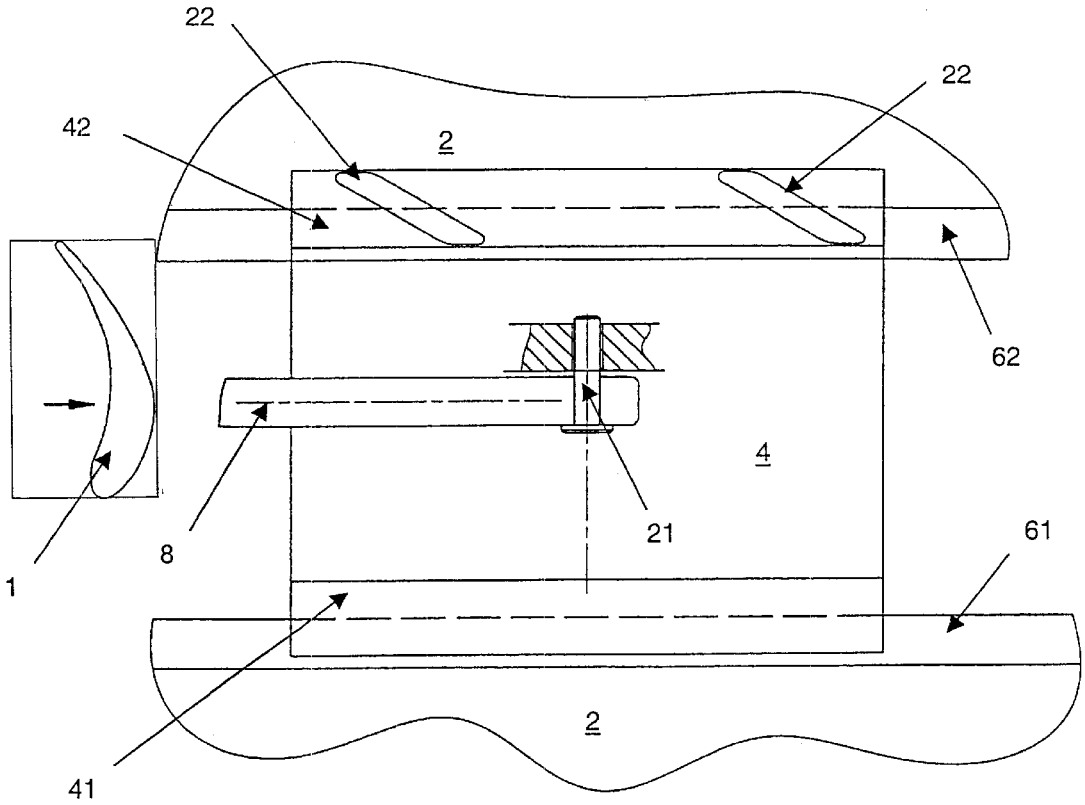
FIG. 2*b* shows an illustration of a top view relating to the device shown in FIG. 2*a*.
Figure 2C:
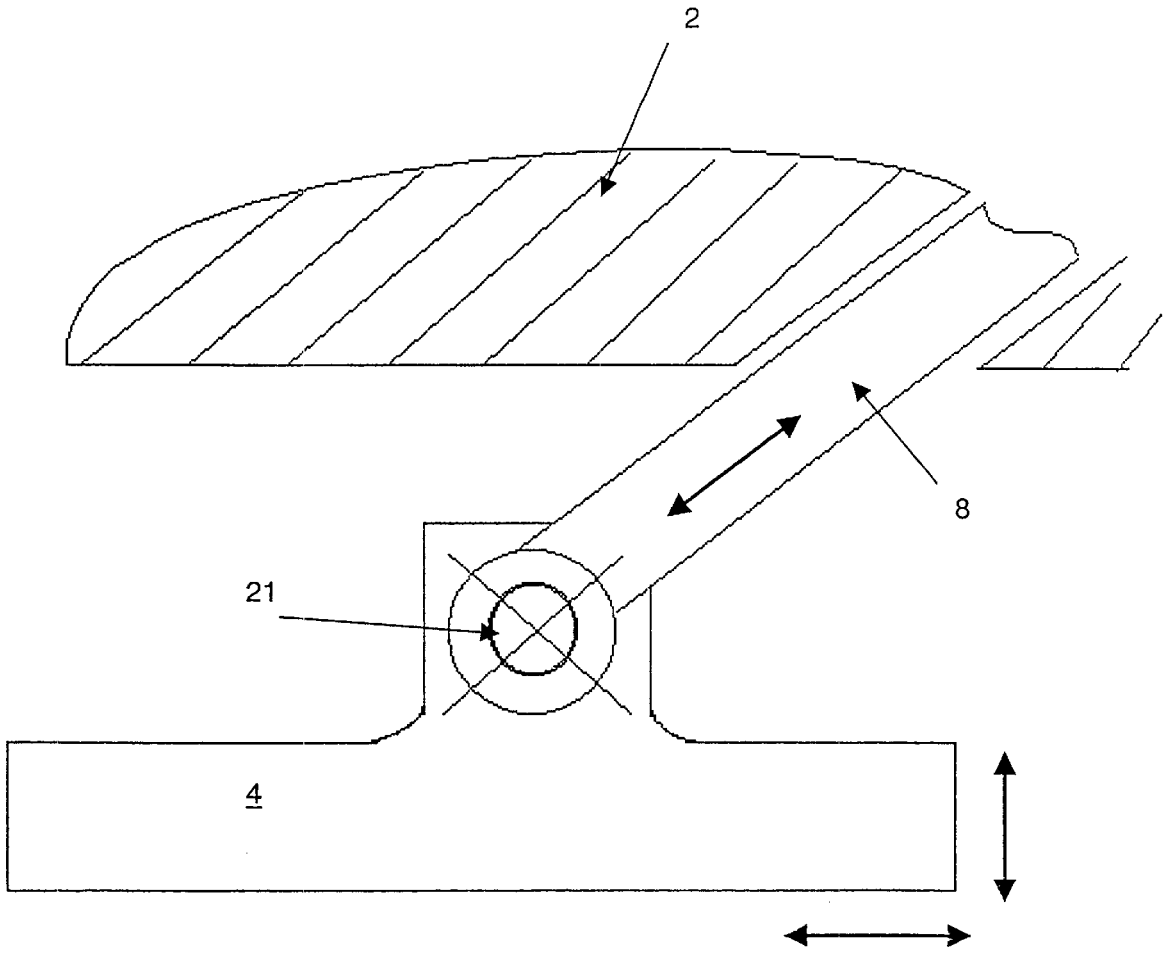
FIG. 2*c* shows an illustration of a detail of the articulation of the drive means on the heat accumulation segment.

Alternatively to the device for setting the gap dimension, illustrated in FIG. 1, FIG. 2*a* shows an illustration corresponding to the sectional illustration according to FIG. 1*a*, but with an alternative solution for the kinematic articulation of the heat accumulation segment 4. The heat accumulation segment 4, again, has a conically designed inner contour 43 which is designed coparallel with the likewise obliquely formed moving-blade crown 3. In this case, too, corresponding edge portions 41, 42 of the heat accumulation segment 4 issue into groove runs 61, 62 within the guide-vane carrier. What is essential in this embodiment, however, is that the groove runs 61, 62 have a pitch running perpendicularly to the drawing plane according to FIG. 2*a* or provide guide slots 22 having a pitch which runs perpendicularly to the drawing plane according to FIG. 2*a* and along which the heat accumulation segment 4 can be displaced in the circumferential direction. For this purpose, the drive means 8 is designed as a rod which projects through the guide-vane carrier 2 obliquely to the direction of rotation. This may be gathered, in particular, from the illustration of the top view according to FIG. 2*b* and FIG. 2*c*. In FIG. 2*a*, the drive means 8 is connected fixedly in terms of rotation about an axis via a bolt connection 21. However, the connection has sufficient play, so that the drive means 8 can be displaced axially in relation to the heat accumulation segment. In particular, the bolt of the bolt connection 21 issues in a sliding or ball-bearing which ensures relative moveability in relation to the heat accumulation segment. When the heat accumulation segment 4 is moved by the drive means 8 designed as a drive rod, it executes a combined movement in the circumferential direction and in the axial direction. As a result of the movement in the circumferential direction, the gap between the moving blade 1 and the heat accumulation segment 4 is thus set. In this case, too, an overload clutch and a mechanical drive system may be provided on the drive rod 8 outside the turbine casing, not illustrated in any more detail, as is illustrated especially in conjunction with the exemplary embodiment according to FIG. 1.

List of Reference Symbols

1 Moving blade
2 Guide-vane carrier
3 Moving-blade end edge, moving-blade crown
4 Heat accumulation segment
41, 42 Edges of the heat accumulation segment
43 Heat accumulation segment surface facing the rotor arrangement
5 Gap
61, 62 Groove run
7 Flow duct
8 Drive means
9 Eccentric unit
91 Guide pin
10 Guide groove
11 Spring-loaded bolt
12 Ball-bearing
13 Turbine casing
14 Drive unit
15 Overload unit, overload clutch
16 Adjusting ring
17 Rack segment
18 Gearwheel
19 Fixed counterbearing
20 Spring element
21 Rotationally moveable bolt connection

What is claimed is:

1. A device for setting the gap dimension for a turbomachine, in particular a gas turbine, with a multiplicity of moving blades arranged in at least one moving-blade row of a rotor arrangement, a guide-vane carrier surrounding the rotor arrangement and a turbine casing surrounding the guide-vane carrier, a multiplicity of heat accumulation segments which are arranged on the guide-vane carrier of the rotor arrangement and at least opposite the moving-blade tips and which, together with the moving-blade tips, enclose a gap, and with at least one drive means which projects radially through the turbine casing and the guide-vane carrier and is operatively connected kinematically to at least one heat accumulation segment and which, when actuated, causes a radial spacing of the heat accumulation segment, wherein the heat accumulation segment has, in the flow direction of the turbomachine, a conical contour facing the rotor arrangement and is arranged so as to be displaceable parallel to the flow direction, and wherein the drive means is connected to the heat accumulation segment directly or via eccentric unit, in such a way that, when the drive means is actuated, the heat accumulation segment is displaced, with the result that a radial spacing between the heat accumulation segment and the moving-blade tips can be set, wherein the drive means is connected to an overload unit which in the event of force-induced contact between the heat accumulation segment and at least one moving-blade tip, allows a radial spacing of the heat accumulation segment.

2. The device as claimed in claim 1, wherein the overload unit is an overload clutch.

3. The device as claimed in claim 1, wherein the drive means is designed as a rod-like rotary spindle, with one end projecting into an interspace delimited by the heat accumulation segment and the guide-vane carrier, said end being connected rotationally moveably to the heat accumulation segment via the eccentric unit.

4. The device as claimed in claim 3, wherein the heat accumulation segment has a guide slot which faces the eccentric unit and into which projects a guide pin connected to the eccentric unit.

5. The device as claimed in claim 4, wherein the guide slot is of linear design and is arranged perpendicularly to the flow direction through the turbomachine.

6. The device as claimed in claim 1, wherein the heat accumulation segment has two opposite edges which engage in each case into countercontoured groove runs within the guide-vane carrier, and wherein the groove runs each have a groove depth such that a displacement of the heat accumulation segment longitudinally to the groove depth of the two grooves is possible.

7. The device as claimed in claim 6, wherein the groove depths extend axially to the turbomachine, so that an axial displacement of the heat accumulation segment takes place as a result of the actuation of the drive means.

8. The device as claimed in claim 1, wherein the drive means is of rod-like design and projects through the turbine casing and the guide-vane carrier obliquely to the turbomachine in the circumferential direction and, with its end projecting into an interspace delimited by the heat accumulation segment and the guide-vane carrier, is connected rotationally and axially moveably to the heat accumulation segment via a spindle, and wherein the heat accumulation segment is connected to the guide-vane carrier via at least one guide contour, in such a way that, in the event of the longitudinal actuation of the drive means along its longitudinal axis, the heat accumulation segment can be moved in the circumferential direction and in the axial direction in relation to the turbomachine.

9. The device as claimed in claim 8, wherein the drive means and the heat accumulation segment are connected via a rotationally moveable bolt connection which allows longitudinal moveability between the drive means the bolt along the bolt axis.

10. The device as claimed in claim 8, wherein the heat accumulation segment has two opposite edges which issue into countercontoured groove runs within the guide-vane carrier, and wherein the groove runs are designed in such a way that, in the event of a movement of the heat accumulation segment in the circumferencential direction, a movement in the axial direction in relation to the turbomachine also takes place at the same time.

11. The device as claimed in claim 1, wherein the drive means is connected to an adjusting device, by which the drive means can be set in rotational movement.

12. The device as claimed in claim 11, wherein the adjusting devices for each heat accumulation segment are kinematically coupled to one another or can be actuated individually.

13. The device as claimed in claim 12, wherein a regulating unit which activates the adjusting units is provided.

14. The device as claimed in claim 1, wherein the overload unit keeps the drive means in a force-free position which is maintained automatically.

15. The device as claimed in claim 1, wherein the heat accumulation segment is secured by means of a securing unit against rotation in the circumferential direction in relation to the guide-vane casing.

16. The device as claimed in claim 15, wherein the securing unit is a spring-tensioned bolt which projects into a recess within the guide-vane casing.

* * * * *